US006028530A

United States Patent [19]

Kondo

[11] Patent Number: 6,028,530

[45] Date of Patent: Feb. 22, 2000

[54] PAGING RECEIVER WITH MESSAGE DIVIDING FUNCTION

[75] Inventor: Hisashi Kondo, Kakegawa, Japan

[73] Assignee: NEC Corporation, Tokyo, Japan

[21] Appl. No.: 08/933,123

[22] Filed: Sep. 18, 1997

[30] Foreign Application Priority Data

Sep. 19, 1996 [JP] Japan ..... 8-248212

[51] Int. Cl.[7] ..... G08B 5/22

[52] U.S. Cl. ..... 340/825.44; 455/38.1; 455/38.2; 455/38.4; 455/557; 370/394

[58] Field of Search ..... 340/825.44; 455/38.1, 455/38.2, 38.4, 557; 370/394

[56] References Cited

U.S. PATENT DOCUMENTS

| | | | |
|---|---|---|---|
| 4,697,281 | 9/1987 | O'Sullivan | 455/557 |
| 5,311,516 | 5/1994 | Kuznicki et al. | 340/825.44 |
| 5,535,427 | 7/1996 | Miyashita et al. | 340/825.44 |
| 5,617,083 | 4/1997 | Schwendeman et al. | 340/825.44 |
| 5,629,940 | 5/1997 | Gaskill | 340/825.44 |

FOREIGN PATENT DOCUMENTS 61-92047 5/1986 Japan .

*Primary Examiner*—Michael Horabik
*Assistant Examiner*—Yves Dalencourt
*Attorney, Agent, or Firm*—Scully, Scott, Murphy & Presser

[57] ABSTRACT

A paging receiver has a function setting memory for storing message division information to divide a message contained in a received message signal into a plurality of messages, and a message processor for dividing the message into a plurality of messages according to the message division information, storing the messages in a message memory, and displaying the messages on a display unit. The paging receiver allows the user to reliably and quickly confirm a long message in the same period of time and with the same operation as when shorter messages divided from the long message and stored in the message memory are confirmed.

12 Claims, 6 Drawing Sheets

| Address | Division Information | | Data Type | Yes/No Information |
|---|---|---|---|---|
| Address 1 | No Div. | | α-Numeric | No Dividing |
| Address 2 | No Div. | | Tone Only | No Dividing |
| Address 3 | Div. 1 | 80 c. | α-Numeric | Yes Dividing |
| | Div. 2 | 160 c. | | |
| | Div. 3 | 80 c. | | |
| | Div. 4 | 160 c. | | |
| Address 4 | No Div. | | Numeric | No Dividing |
| Address 5 | Div. 1 | 25 c. | α-Numeric | Yes Dividing |
| | Div. 2 | 72 c. | | |
| | Div. 3 | 140 c. | | |
| Address 6 | Div. 1 | 20 c. | α-Numeric | Yes Dividing |
| | Div. 2 | 20 c. | | |
| | Div. 3 | 20 c. | | |
| | Div 4 | 80 c. | | |
| | Div. 5 | 860 c. | | |

c : character

FIG. 4

| | |
|---|---|
| Address 1 | Message 1 240 c. |
| Address 6 | Message 1 80 c. |
| Address 3 | Message 1-1 80 c. |
| Address 3 | Message 1-2 160 c. |
| Address 3 | Message 1-3 80 c. |
| Address 3 | Message 1-4 160 c. |
| Address 1 | Message 2 |
| Address 4 | Message 1 |
| ⋮ | ⋮ |

c : character

FIG.6

PAGING RECEIVER WITH MESSAGE DIVIDING FUNCTION

BACKGROUND OF THE INVENTION

1. Field of the Invention

The present invention relates to a paging receiver which is capable of receiving messages.

2. Description of the Related Art

As society becomes more and more information-dependent, messages handled by paging receivers contain a growing amount of information, and the length of each of such messages tends to be greater. Heretofore, it has been customary for a paging receiver to read a received message either from a first letter or page thereof or from a last letter of page thereof.

Various information services for providing weather forecasts, traffic information, stock prices, exchange rates, etc. are likely to send messages at one time. When a paging receiver receives a long message from one of such services, the period of time required for the user of the paging receiver to confirm the contents of the message depends upon the position where desired information is located in the long message. Even if the position of desired information is known in a message sent from an information service to a paging receiver, it will take the user too long a time until the user can confirm the information.

SUMMARY OF THE INVENTION

It is an object of the present invention to provide a paging receiver which allows the user to reliably and quickly confirm a long message in the same period of time and with the same operation as when shorter messages divided from the long message and stored in a memory are confirmed.

To achieve the above object, there is provided in accordance with the present invention a paging receiver for receiving a paging signal including at least an address and a message corresponding to the address, comprising a decoder for decoding a paging signal into a signal to be processed by data processing, message division information storage means for storing message division information to divide a message contained in the signal from the decoder into a plurality of messages, and message processing means for dividing the message into a plurality of messages according to the message division information, storing the messages in a message memory, and displaying the messages on a display unit.

The message division information may comprise information for dividing the message depending on a type of the message contained in the signal.

The message processing means may comprise means for dividing the message according to a sequence of the numbers of characters stored in the message division information storage means, and storing the messages divided according to the sequence in the message memory or displaying the messages divided according to the sequence on the display unit.

The message processing means may comprise means for determining whether the message is to be divided based on division permission/inhibition information stored in the message division information storage means, storing the message in the message memory without dividing the message if the division permission/inhibition information indicates a division inhibition, and dividing the message into the messages and storing the messages in the message memory if the division permission/inhibition information indicates a division permission.

The message processing means may comprise setting means for establishing a predetermined sequence based on which to display the messages on the display unit.

The message processing means may comprise selecting means for issuing a deletion/preservation command for individually deleting or preserving the messages.

The above and other objects, features, and advantages of the present invention will become apparent from the following description with references to the accompanying drawings which illustrate an example of the present invention.

BRIEF DESCRIPTION OF THE DRAWINGS

FIG. 4 is a diagram showing a memory map of a message division information memory in the paging receiver;

FIG. 6 is a diagram showing a memory map of a message memory in the paging receiver.

DESCRIPTION OF THE PREFERRED EMBODIMENT

Figure 2:
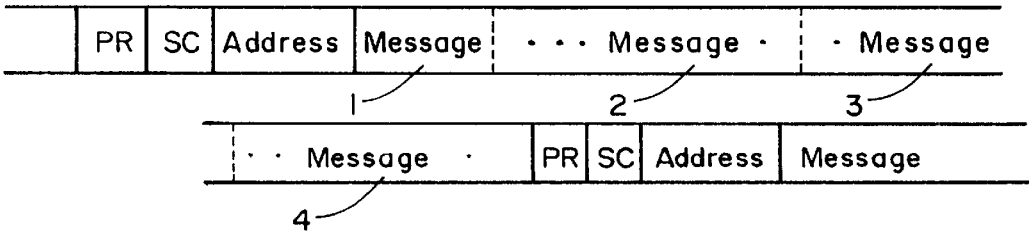
FIG. 2 is a diagram showing the data format of a signal received by the paging receiver.

An example of the present invention will next be described with reference to the accompanying figures. As shown in FIG. 2, the received signal or paging signal comprises a PR signal as a synchronization unit signal for achieving bit synchronization, an SC signal for achieving word synchronization, an address of the paging receiver to be paged, and messages. Some of the messages which follow the address are long, and the others are short. Therefore, the length of a message is variable. An end of the messages is determined by a message end signal or an address signal. Each of paging receivers has one or more addresses, which are used to pay desired paging receivers.

Figure 1:
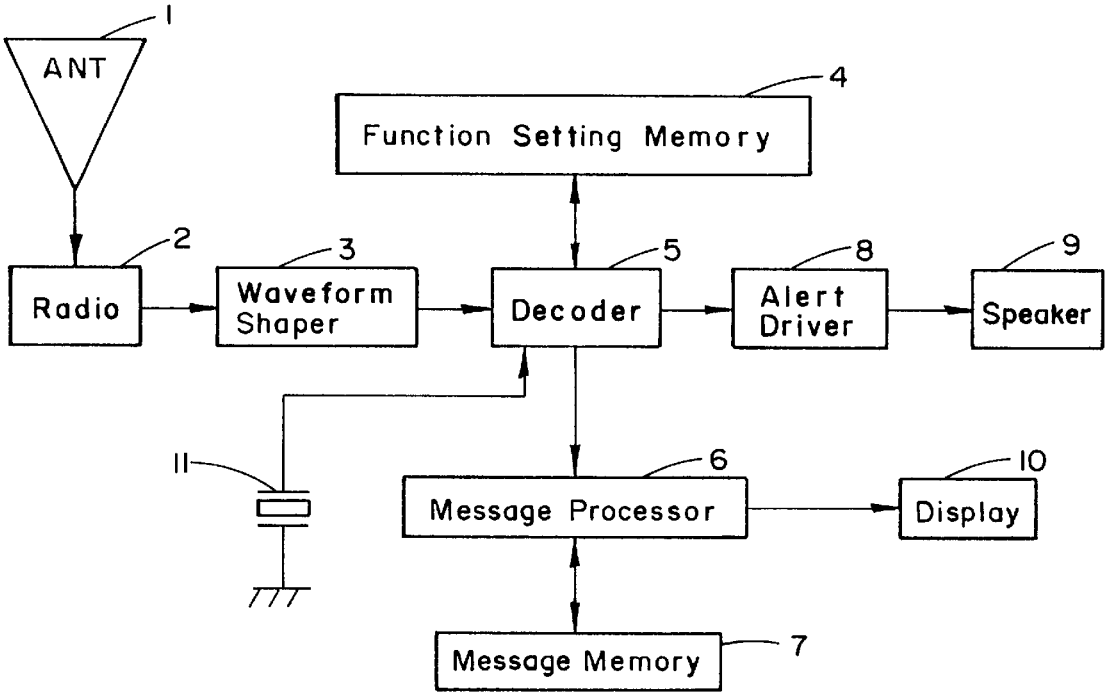
FIG. 1 is a block diagram of a paging receiver according to the present invention.

FIG. 1 shows in block form the paging receiver according to the present invention. As shown in FIG. 1, the paging receiver comprises an antenna 1, a radio unit 2 for amplifying and demodulating a message signal received by the antenna 1, a waveform shaper 3 for shaping the waveform of a demodulated signal from the radio unit 2, a function setting memory 4 serving as a message division information storage means for storing addresses, message division information, and division permission/inhibition information, a decoder 5 for decoding a waveform-shaped output signal from the waveform shaper 3 into a signal to be processed subsequently by data processing, a message processor 6 as a message processing means for processing a signal from the decoder 5, a message memory 7 for storing a character signal from the message processor 6, an alert driver 8 for receiving an alarm signal from the decoder 5, a speaker 9 for producing an alarm sound in response to the alarm signal from the alert driver 8, and a display unit 10 for displaying message information.

Operation of the paging receiver will be described below. A message signal received by the antenna 1 is amplified and demodulated by the radio unit 2, and a demodulated signal from the radio unit 2 is shaped in waveform by the waveform shaper 3. Then, the decoder 5 decodes a waveform-shaped output signal from the waveform shaper 3. Furthermore, the decoder 5 reads addresses and message division information stored in the function setting memory 4 and compares the addresses with an address contained in the received signal as converted into a digital signal. If the compared addresses agree with each other, then the decoder 5 sends message division information corresponding to the address and a message signal following the address to the message processor 6. The decoder 5 also sends an alarm signal to the alert driver 8, which controls the speaker 9 to produce an alarm sound indicating that the user of the paging receiver is being paged.

If no message division information is sent from the decoder 5 to the message processor 6, then the message processor 6 decodes a message signal from the decoder 5 into a character signal. The message processor 6 stores the character signal into the message memory 7 and sends message information represented by the character signal to the display unit 10 to display a message thereon. If the message processor 6 receives a request for displaying a message from a switch on the paging character, then the message processor 6 displays a message on the display unit 10.

If message division information is sent from the decoder 5 to the message processor 6, then the message processor 6 divides a received message represented by a message signal from the decoder 5 into a plurality of messages based on the message division information from the decoder 5. The message processor 6 stores these messages into the message memory 7 and displays the messages on the display unit 10.

Figure 3:
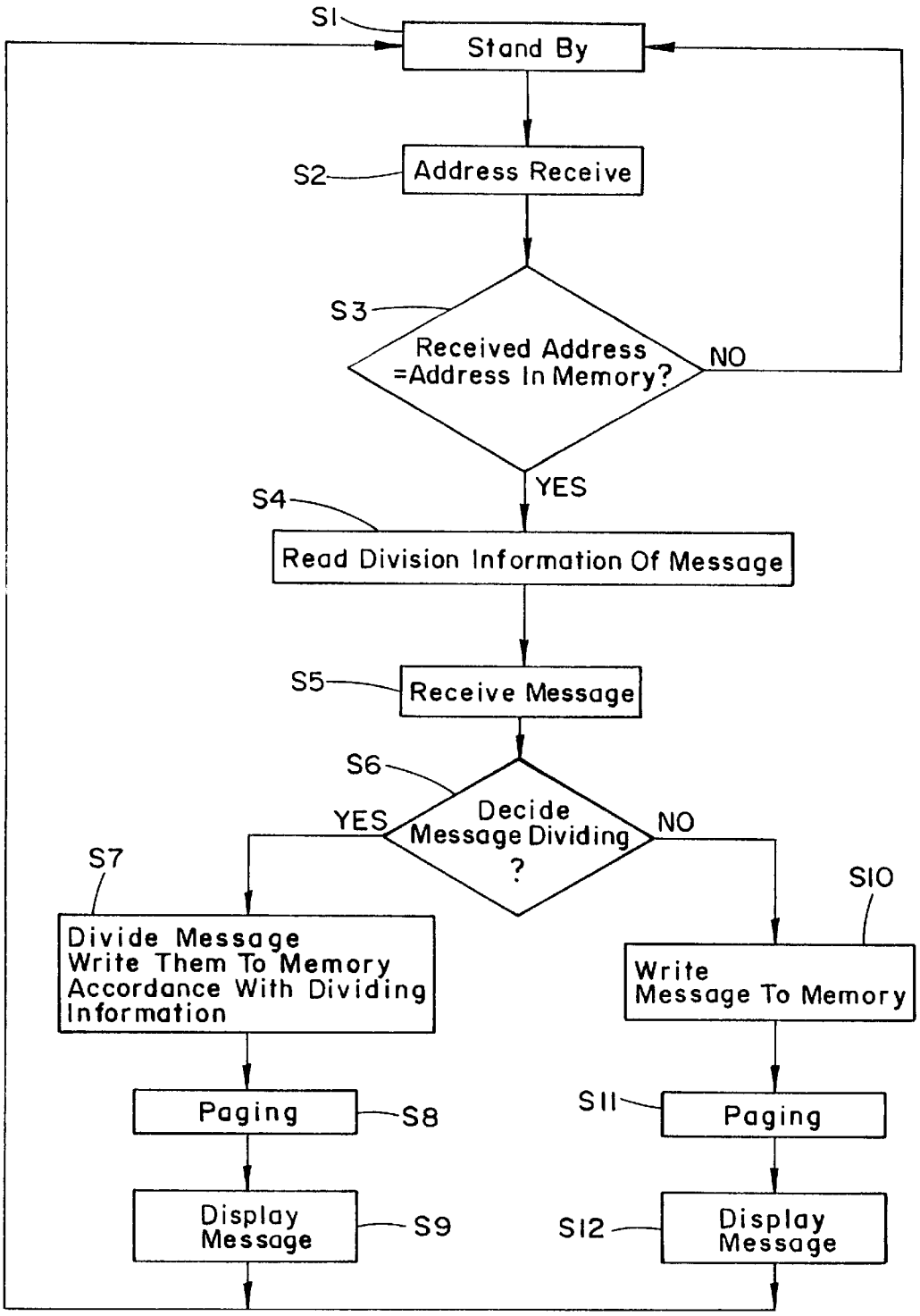
FIG. 3 is a flowchart of a processing sequence for processing a message received by the paging receiver.

FIG. 3 shows a processing sequence for processing a message received by the paging receiver. A process of dividing a received message will be described below with reference to FIG. 3. Usually, the paging receiver is in a standby condition for receiving a paging signal in a step S1. When the paging receiver receives an address of a paging signal shown in FIG. 2 in a step S2, the received address is compared with the addresses stored in the function setting memory 4 in a step S3. If the compared addresses do not agree with each other, then control goes back to the step S1.

If the compared addresses agree with each other, then message division information corresponding to the address and division permission/inhibition information are read from the function setting memory 4 into the decoder 5 in a step S4, and a message signal following the address is transferred to the message processor 6 in a step S5. The message processor 6 then determines whether the message represented by the received address is to be divided or not based on the division permission/inhibition information in a step S6. If the division permission/inhibition information indicates a division inhibition, then the message processor 6 does not divide the received message, and stores the message into the message memory 7 in a step S10. The speaker 9 is actuated to produce an alarm sound in a step S11, indicating that the user is being paged. The message is displayed on the display unit 10 in a step S12.

If the division permission/inhibition information indicates a division permission in the step S6, then the message processor 6 divides the message into a plurality of messages according to the message division information, and stores the messages into the message memory 7 in a step S7. Thereafter, the speaker 9 is actuated to produce an alarm sound in a step S8, indicating that the user is being paged. The messages are displayed on the display unit 10 in a step S9.

After the message or messages are displayed in the step S9 or S12, the paging receiver is back in the standby condition.

FIG. 4 shows a memory map of the function setting memory 4. As shown in FIG. 4, the function setting memory 4 stores message division information, data types, and division permission/inhibition information for respective addresses. The data types represent types of messages, e.g., Tone Only messages (messages in sound only), Numeric messages (messages expressed by numbers and symbols), and α-Numeric messages (messages expressed by alphanumeric characters). Other message types are messages expressed by KANJI characters and messages expressed by KANA characters. These data types for respective addresses are stored in the function setting memory 4. A message is divided according to a sequence of the numbers of characters contained in message division information. For example, a message having an address 3 is divided into a first message comprising 80 characters, a second message comprising 160 characters, a third message comprising 80 characters, and a fourth message comprising 160 characters.

In the step S6, the message processor 6 determines whether a message is to be divided or not on the basis of the division permission/inhibition information. In various information services for providing weather forecasts, traffic information, stock prices, exchange rates, etc., messages often have a predetermined format and length. Therefore, it is easy to determine desired message positions or the numbers of characters by which a message is to be divided for better readability. Since messages are sent with specific addresses from those information services, it is possible to establish message division information for the respective addresses.

Figure 5:
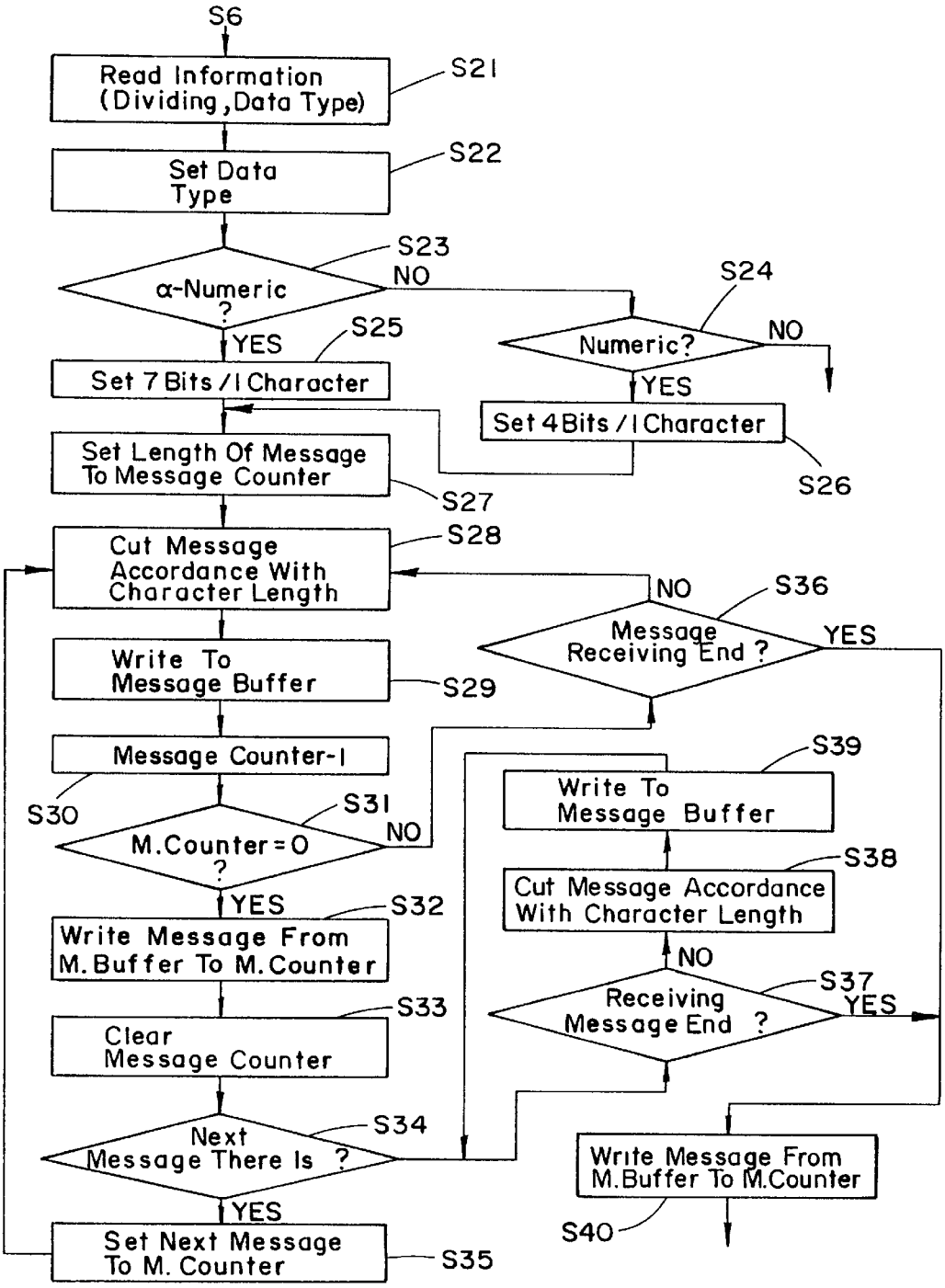
FIG. 5 is a flowchart of a processing sequence for dividing and storing a message.

The step S7 in which a message is divided into a plurality of messages by the message processor 6 and the messages are stored into the message memory 7 will be described in detail with reference to a processing sequence shown in FIG. 5. As shown in FIG. 5, the message processor 6 reads message division information from the decoder 5 in a step S21, and establishes a data type of a message in a step S22. Then, the message processor 6 determines whether the established data type is α-Numeric or not in a step S23. If the data type is α-Numeric, then the message processor 6 sets the bit length of one character to 7 bits in a step S25. If the data type is not α-Numeric, then the message processor 6 determines whether the established data type is Numeric or not in a step S24. If the data type is Numeric, then the message processor 6 sets the bit length of one character to 4 bits in a step S26. If the data type is neither α-Numeric nor Numeric, then the message processor 6 determines that the data type is Tone Only, and control goes to the step S8 in FIG. 3.

The message processor 6 sets a message counter to the number of characters equal to the length of a message in a step S27. Then, the message processor 6 reads a character from the message according to the bit length of one character in a step S28. Specifically, if the data type is Numeric, then the message processor 6 reads a character of 4 bits from the message, and if the data type is α-Numeric, then the message processor 6 reads a character of 7 bits from the message. The message processor 6 then stores the character into a message buffer in a step S29. Each time the message processor 6 stores one character into the message buffer, the message processor 6 decrements the message counter by 1 in a step S30. The message processor 6 then determines whether the count of the message counter is 0 or not in a step S31.

If the count of the message counter is not 0, then the message processor 6 determines whether the message comes to an end or not in a step S36. If the message comes to an end, then the message processor 6 stores the message in the message buffer into the message memory 7 in a step S40. Thereafter, control goes to the step S8 in FIG. 3.

If the message does not come to an end, then the message processor 6 control returns to the step S28. The steps S28, S29, S30, S31, S36 are repeated until the count of the message counter is 0 or the message comes to an end.

If the count of the message counter is 0 in the step S31, then the message processor 6 stores the message in the message buffer into the message memory 7 in a step S32, and clears the message counter in a step S33. The message processor 6 determines whether there is information with respect to a next message length or not in a step S34. If there is information with respect to a next message length, then the message processor 6 sets the message counter to the next message length in a step S35. Then, the steps S28, S29, S30, S31, S36 are repeated. If there is no longer information with respect to a next message length in the step S34, then the message processor 6 determines whether the message reception comes to an end in a step S37. If the message reception comes to an end, then the message processor 6 stores the message in the message buffer into the message memory 7 in the step S40, after which control goes to the step S8 in FIG. 3.

If the message reception does not come to an end in the step S37, then the message processor 6 reads a character from the message according to the bit length of one character in a step S38, and stores the character into the message buffer in a step S39. The message processor 6 repeats the steps S38, S39 until the message reception comes to an end. If the message reception comes to an end, then the message processor 6 stores the message in the message buffer into the message memory 7 in the step S40, after which control goes to the step S8 in FIG. 3.

FIG. 6 shows how divided messages are stored in the message memory 7. As shown in FIG. 6, messages 1-1~1-4 at an address 3 are stored in the message memory 7 according to the message division information shown in FIG. 4, the message 1-1 comprising 80 characters, the message 1-2 comprising 160 characters, the message 1-3 comprising 80 characters, and the message 1-4 comprising 160 characters.

As described above, since the message memory 7 stores divided messages in the same manner as with independent complete messages, the paging receiver according to the present invention allows the user to establish any arbitrary sequence of divided messages to be displayed upon reception. The paging receiver is capable of individually preserving and deleting divided messages. Because it is not necessary to store an unwanted long message in the message memory 7, the storage capacity of the message memory 7 can effectively be utilized.

Figure 7:
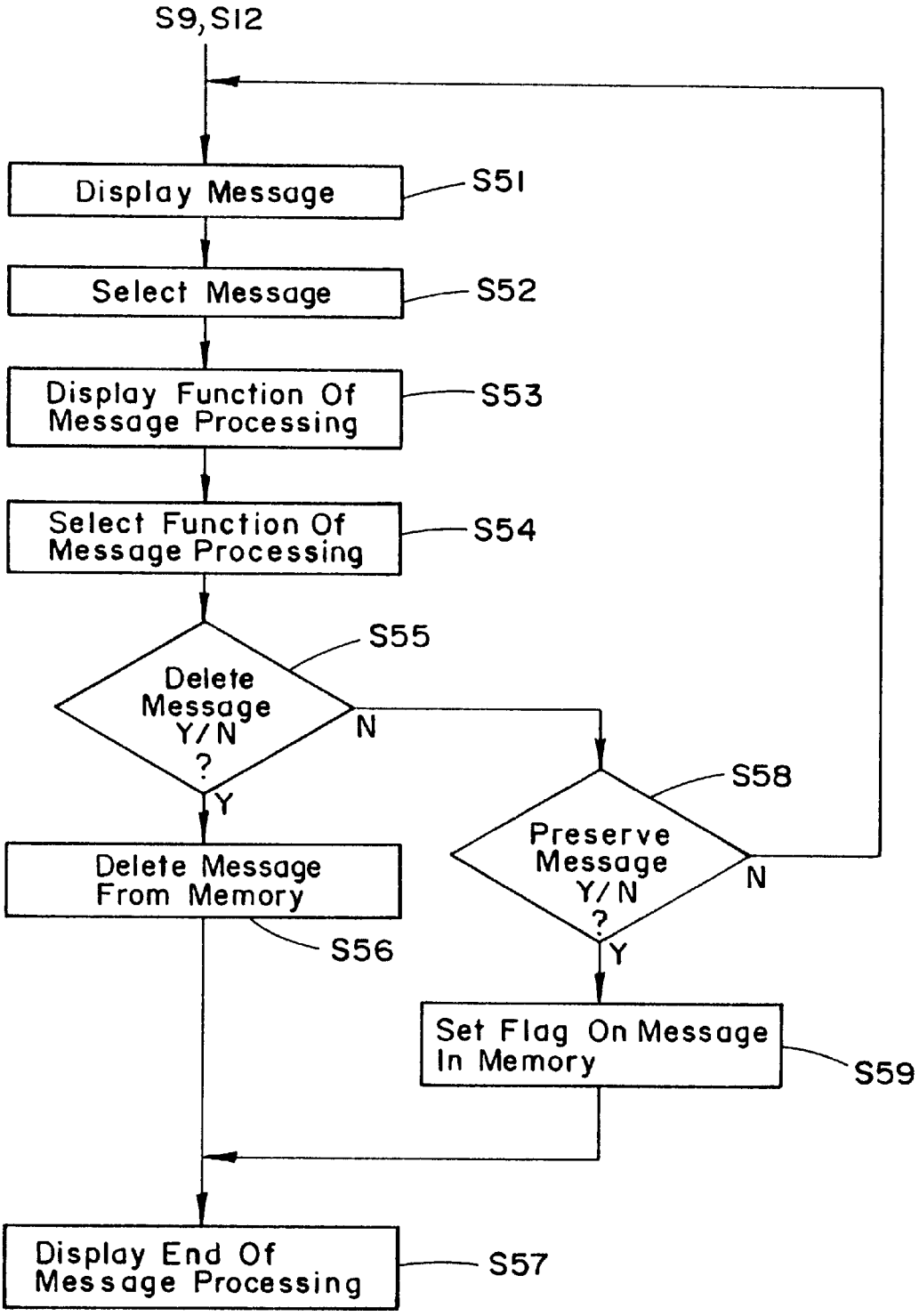
FIG. 7 is a flowchart of a processing sequence for deleting and preserving a message.

A processing sequence for deleting and preserving divided messages will be described below with reference to FIG. 7.

When messages are displayed on the display unit 10 in a step S51, the user of the paging receiver operates a selection button to select a message to be deleted or preserved among the displayed messages in a step S52. When the user selects a desired message, message processing functions are displayed in a step S53. The user selects desired ones of the displayed message processing functions with the selection button in a step S54. When selected, a message deleting function and a message preserving function are successively displayed. If the user wants to delete the message, then the user presses a function determining button to determine the message deleting function, and the display unit 10 displays ※MESSAGE TO BE DELETED※. If the user presses an execute button in a step S55, then the message is deleted from the message memory 7 in a step S56, and the end of the message processing is displayed in a step S57. If the user does not press the execute button in the step S55, then the display unit 10 displays ※MESSAGE TO BE PRESERVED※. If the user confirms the displayed information and then presses the execute button in a step S58, then a message preservation flag is set for the message in the message memory 7 in a step S59, and the message is preserved. Thereafter, the end of the message processing is displayed in the step S57. If the execute button is not pressed, but the selection button is pressed, then the message is not preserved, but is displayed on the display unit 10 in the step S51. The message deleting function and the message preserving function are canceled. Since the divided messages are independently established as shown in FIG. 4, they can be deleted or preserved in the same manner as with normal messages.

A sequence of messages may be entered as sequence data by an input unit, and the sequence data may be stored as a flag in the message memory. The messages may then be displayed according to the sequence based on the sequence data.

With the present invention, as described above, when a long message is received or when a long message is to be confirmed, it can reliably and quickly be confirmed in the same period of time and with the same operation as when shorter messages divided from the long message and stored in the message memory are confirmed.

If a message format and a message length are predetermined for messages provided by certain information services, then divided messages can be selectively stored, displayed, and confirmed with ease.

Furthermore, divided messages can be preserved, deleted, and displayed selectively by paging numbers.

A message which is inhibited from being divided and messages divided from a message which is permitted to be divided can be stored at respective addresses in the message memory, and, when necessary, a designated one of the stored messages can be read and displayed on the display unit.

Moreover, messages can be displayed in an appropriate sequence depending on their contents, and only those message which are necessary can be displayed.

While a preferred embodiment of the present invention has been described using specific terms, such description is for illustrative purposes only, and it is to be understood that changes and variations may be made without departing from the spirit or scope of the following claims.

What is claimed is:

1. A paging receiver for receiving a paging signal including at least an address and a message corresponding to the address, comprising:

a decoder for decoding a paging signal into a signal to be processed by data processing;

message division information storage means for storing message division information to divide a message contained in the signal from said decoder into a plurality of messages; and message processing means for dividing said message into a plurality of messages according to said message division information, storing said messages in a message memory, and displaying said messages on a display unit.

2. A paging receiver according to claim 1, wherein said message division information comprises information for dividing said message depending on a format of the message contained in said signal.

3. A paging receiver according to claim 1, wherein said message processing means comprises means for dividing said message according to a sequence of the numbers of characters stored in said message division information storage means, and storing the messages divided according to said sequence in said message memory or displaying the messages divided according to said sequence on said display unit.

4. A paging receiver according to claim 1, wherein said message processing means comprises means for determining whether said message is to be divided based on division permission/inhibition information stored in said message division information storage means, storing the message in said message memory without dividing the message if said division permission/inhibition information indicates a division inhibition, and dividing the message into the messages and storing the messages in said message memory if said division permission/inhibition information indicates a division permission.

5. A paging receiver according to claim 1, wherein said message processing means comprises setting means for establishing a predetermined sequence based on which to display said messages on said display unit.

6. A paging receiver according to claim 2, wherein said message processing means comprises setting means for establishing a predetermined sequence based on which to display said messages on said display unit.

7. A paging receiver according to claim 3, wherein said message processing means comprises setting means for establishing a predetermined sequence based on which to display said messages on said display unit.

8. A paging receiver according to claim 4, wherein said message processing means comprises setting means for establishing a predetermined sequence based on which to display said messages on said display unit.

9. A paging receiver according to claim 1, wherein said message processing means comprises selecting means for issuing a deletion/preservation command for individually deleting, or preserving said messages.

10. A paging receiver according to claim 2, wherein said message processing means comprises selecting means for issuing a deletion/preservation command for individually deleting or preserving said messages.

11. A paging receiver according to claim 3, wherein said message processing means comprises selecting means for issuing a deletion/preservation command for individually deleting or preserving said messages.

12. A paging receiver according to claim 4, wherein said message processing means comprises selecting means for issuing a deletion/preservation command for individually deleting or preserving said messages.

* * * * *